US010223940B2

(12) United States Patent
Pollard

(10) Patent No.: US 10,223,940 B2
(45) Date of Patent: Mar. 5, 2019

(54) BUCKET LIST DISPLAY DEVICE

(71) Applicant: Owen Craig Pollard, Vista, CA (US)

(72) Inventor: Owen Craig Pollard, Vista, CA (US)

( * ) Notice: Subject to any disclaimer, the term of this patent is extended or adjusted under 35 U.S.C. 154(b) by 0 days.

(21) Appl. No.: 15/081,453

(22) Filed: Mar. 25, 2016

(65) Prior Publication Data

US 2017/0278434 A1 Sep. 28, 2017

(51) Int. Cl.
*G09F 7/10* (2006.01)

(52) U.S. Cl.
CPC ..... *G09F 7/10* (2013.01)

(58) Field of Classification Search
CPC ..... G09F 7/10; G09F 7/18
See application file for complete search history.

(56) References Cited

U.S. PATENT DOCUMENTS 452,111 A * 5/1891 Reamer ..... G09F 7/10 40/611.06
775,044 A * 11/1904 Mooser et al. ..... B42F 17/00 283/117
1,720,328 A * 7/1929 Henderson ..... G09F 7/10 40/611.08
1,921,202 A * 8/1933 Mungen ..... G09F 7/10 40/611.06
4,292,752 A * 10/1981 Clark ..... G09F 7/08 40/576
4,425,727 A * 1/1984 Waldekrantz ..... G09B 29/001 211/DIG. 1
4,884,352 A * 12/1989 Lipscomb ..... G09F 7/10 40/489
6,178,679 B1 * 1/2001 Dundorf ..... G09F 7/10 40/5

* cited by examiner

*Primary Examiner* — Gary C Hoge
(74) *Attorney, Agent, or Firm* — John R. Ross; John R. Ross, III

(57) ABSTRACT

A bucket list display device. Multiple goal mounts and achievement mounts are mounted onto a mounting board. Each achievement mount is mounted next to a corresponding goal mount. Goal placards are removably attached to the goal mounts and achievement placards are removably attached to the achievement mounts. Each goal placard refers to a desired goal to be achieved. Each achievement placard provides a statement that indicates if the goal has been accomplished or if it has not yet been accomplished. In one preferred embodiment the goal placards refer to golf courses that the user hopes to one day play.

6 Claims, 7 Drawing Sheets

BUCKET LIST DISPLAY DEVICE

The present invention relates to display devices, and in particular, to motivational display devices.

BACKGROUND OF THE INVENTION

Bucket List

In contemporary society bucket lists are well known. The term "bucket list" is a term that commonly refers to a list of goals, experiences or achievements that a person hopes to have or accomplish during their lifetime. For example, a typical bucket list item might be to "Hike the Grand Canyon". Another common bucket list item might be to "Go Sky Diving". While some people commit their bucket list to memory, others may write down their entire bucket list or parts of it.

The prior art includes various devices that allow individuals to write down their goals and track any accomplishments for their viewing and motivation. These devices include calendars, games and various displays on computer monitor screens. However, none of these devices provide a mechanism that allows an individual to display his goals in an attractive and efficient manner so that he and others can observe the goals and observe his progress in accomplishing the goals. It is recognized that individuals who write down their goals and view their goal list frequently have greater chance of achieving their goals than individuals who just commit their goals to memory.

What is needed is a better device that allows a user to display and update his bucket list.

SUMMARY OF THE INVENTION

The present invention provides a bucket list display device. Multiple goal mounts and achievement mounts are mounted onto a mounting board. Each achievement mount is mounted next to a corresponding goal mount. Goal placards are removably attached to the goal mounts and achievement placards are removably attached to the achievement mounts. Each goal placard refers to a desired goal to be achieved. Each achievement placard provides a statement that indicates if the goal has been accomplished or if it has not yet been accomplished. In one preferred embodiment the goal placards refer to golf courses that the user hopes to one day play.

DETAILED DESCRIPTION OF PREFERRED EMBODIMENTS OF THE PRESENT INVENTION

Figure 1:
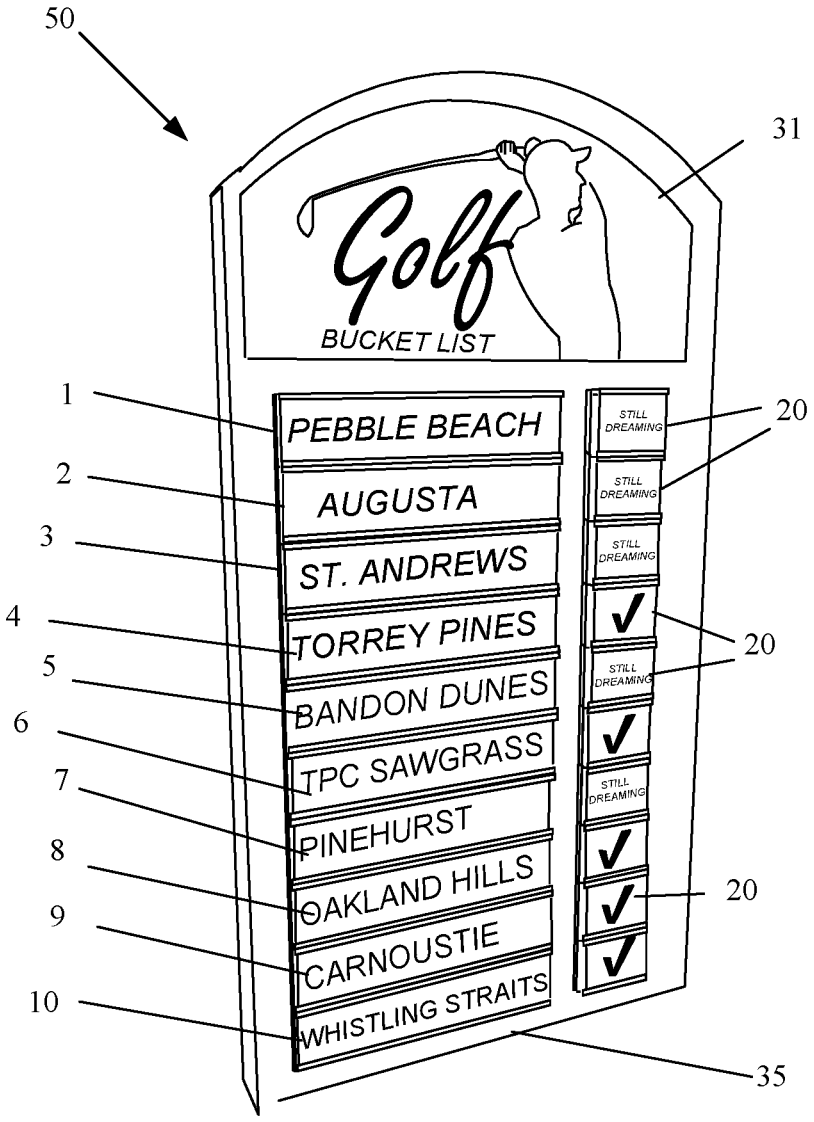
FIG. 1 shows a perspective view of a preferred embodiment of the present invention.

FIG. 1 shows a preferred embodiment of the present invention. Bucket list display device 50 shows goal placards 1-10 mounted onto mounting board 35. An achievement placard 20 is mounted adjacent to each goal placard 1-10. On one side of achievement placard 20 is written the words "Still Dreaming" on the other side of achievement placard 20 a checkmark is drawn.

In a preferred embodiment of the present invention, a user will hang bucket list display device 50 on his wall where it can be seen by himself and his visitors. Goal placards 1-10 are prominently displayed on bucket list display device 50 as shown. If the user has not accomplished his goal, achievement placard 20 corresponding to the goal placard 1-10 will display "Still Dreaming". Conversely, if the user has accomplished his goal, then achievement placard 20 corresponding to goal placard 1-10 will display the checkmark.

For example, in FIG. 1, the user is displaying goal placard 1 "Pebble Beach". This means that it is the user's goal to play golf at Pebble Beach. Achievement placard 20 positioned next to goal placard 1 is displaying the words "Still Dreaming". This means that the user has not yet played golf at Pebble Beach but he still has it as his goal to one day play golf at Pebble Beach. Also in FIG. 1, the user is displaying goal placard 4 "Torrey Pines". This means that it is the user's goal to play golf at Torrey Pines. Achievement placard 20 positioned next to goal placard 4 displays a checkmark. This means that the user has successfully accomplished his goal of playing golf at Torrey Pines.

In a similar fashion it can be seen that the user has yet to achieve his goals of playing golf at Pebble Beach, Augusta, St. Andrews, Bandon Dunes, and Pinehurst. However, it can be seen that the user has accomplished his goals of playing golf at Torrey Pines, TPC Sawgrass, Oakland Hills, Carnoustie, and Whistling Straits.

By the user observing display device 50, he is constantly reminded of his goals. His focus on his goals will therefore be increased. This will cause his daily activities to be more focused so that he is better able to achieve his goals that are written and displayed on display device 50. For example, the golf courses listed on bucket list 1 are very prestigious courses located throughout the world. It is very expensive to travel to these courses, find accommodations, and then pay for the rounds of golf. It also requires careful planning of the user's schedule to be able to organize the golf trips. For a golfer to play at all of these courses is very impressive. Displaying and observing bucket list display device 50 will motivate the user to conduct his daily life so that he is able to achieve these goals. When he accomplishes his goals he will be able to reward himself by flipping achievement placard 20 so that it displays the checkmarks. Additionally, display device 50 is attractive and a strong conversation piece so the user's visitors will observe the board and will be inclined to comment upon the board and ask questions about the board. This will further remind the user of his goals and will serve as a motivating force to prompt the user to take actions so that he is able to accomplish as many of the goals as he can. Once the goal is accomplished the user will be able to display the checkmark and see that is he is moving closer to his ultimate goal of accomplishing everything on bucket list display device 50.

Goal Mounts and Achievement Mounts

Figure 2A:
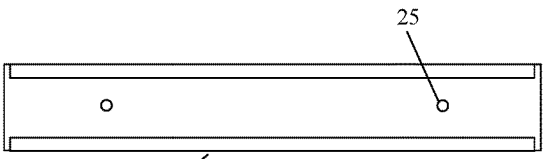
FIGS. 2A-2I show components of a preferred embodiment of the present invention.
Figure 2B:
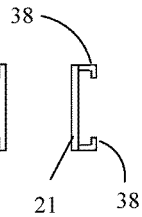
Figure 2C:
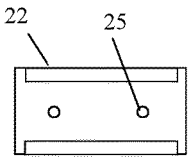
Figure 2D:
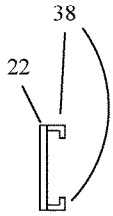

FIG. 2A shows a front view of goal mount 21 having screw mounting holes 25. FIG. 2B shows a side view of goal mount 21. FIG. 2C shows a front view of achievement mount 22. FIG. 2D shows a side view of achievement mount 22. In a preferred embodiment, goal mount 21 and achievement mount 22 are both fabricated from plastic. Mounts 21 and 22 both include retaining edges 38 which allow for placards 1 and 20 to slide through mounts 21 and 22, respectively.

The Placards

Figure 2E:
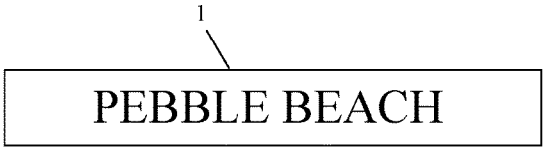
Figure 2F:
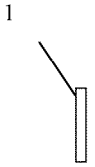
Figure 2G:
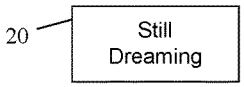
Figure 2H:
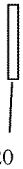
Figure 2I:
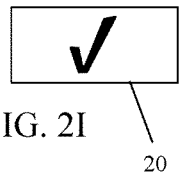

FIG. 2E shows a front view of goal placard 1 and FIG. 2F shows a side view of goal placard 1. FIG. 2G shows a front view of one side of achievement placard 20 and FIG. 2I shows the opposite side of achievement placard 20. FIG. 2H shows a side view of achievement placard 20.

Mounting Board

Figure 3:
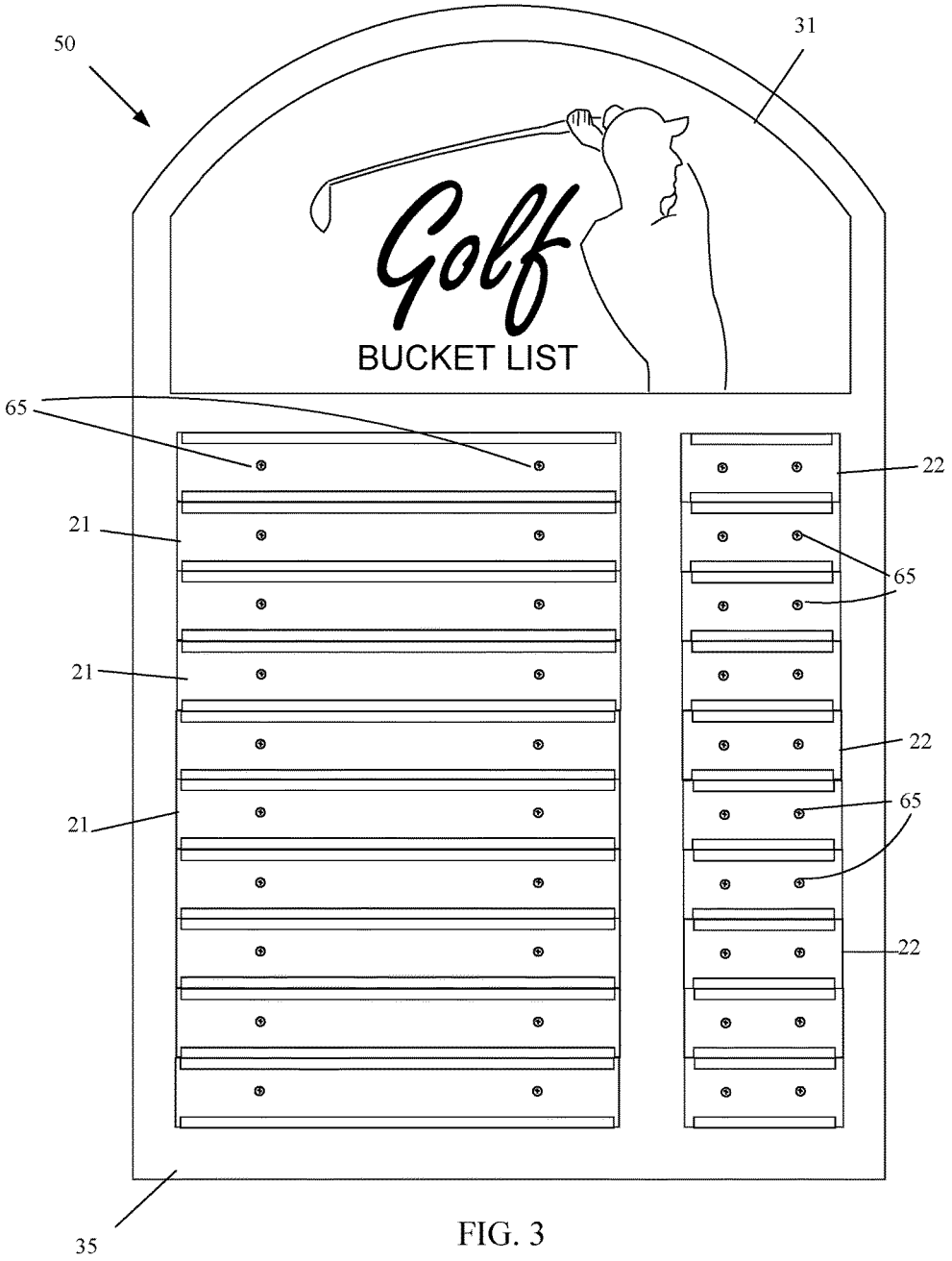
FIG. 3 shows a front view of a mounting board with mounts attached.

FIG. 3 shows a front view of bucket list display device 50. In one preferred embodiment mounting board 35 is fabricated from wood (see also FIG. 1). Mounting board 35 is preferably approximately 1 inch thick, approximately 18 inches wide and approximately 36 inches tall and may be mounted on a wall in a fashion similar to a painting or a photograph.

Goal mounts 21 and achievement mounts 22 are rigidly attached to board 35 via screws 65. In a preferred embodiment of the present invention, ten goal mounts 21 and ten achievement mounts 22 are rigidly attached via screws 65 to board 35, as shown in FIG. 3. In a preferred embodiment, descriptive section 31 describes the purpose of display device 50. For example, in FIG. 3, the purpose of display device 50 is to list the achievement goals for a golf bucket list.

Utilization of the Bucket List Display Device

Figure 4:
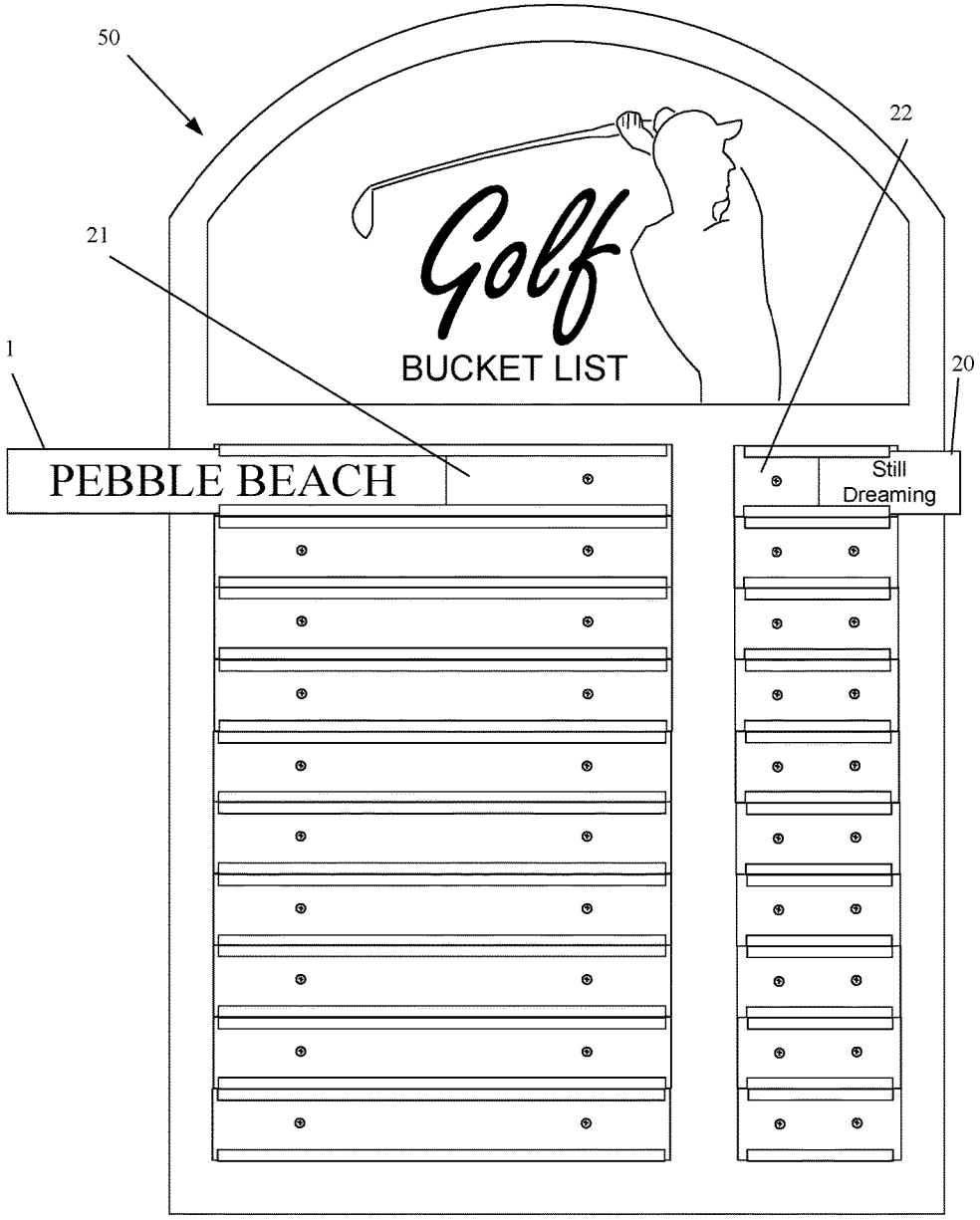
FIG. 4 shows a goal placard and an achievement placard partially inserted into mounts.

FIG. 4 shows a front view of bucket list display device 50. In FIG. 4, the user has partially slid achievement placard 1 into the top goal mount 21. Also, the user has partially slid achievement placard 20 into achievement mount 22, as shown. Achievement placard 20 is displaying the words "Still Dreaming".

Figure 5:
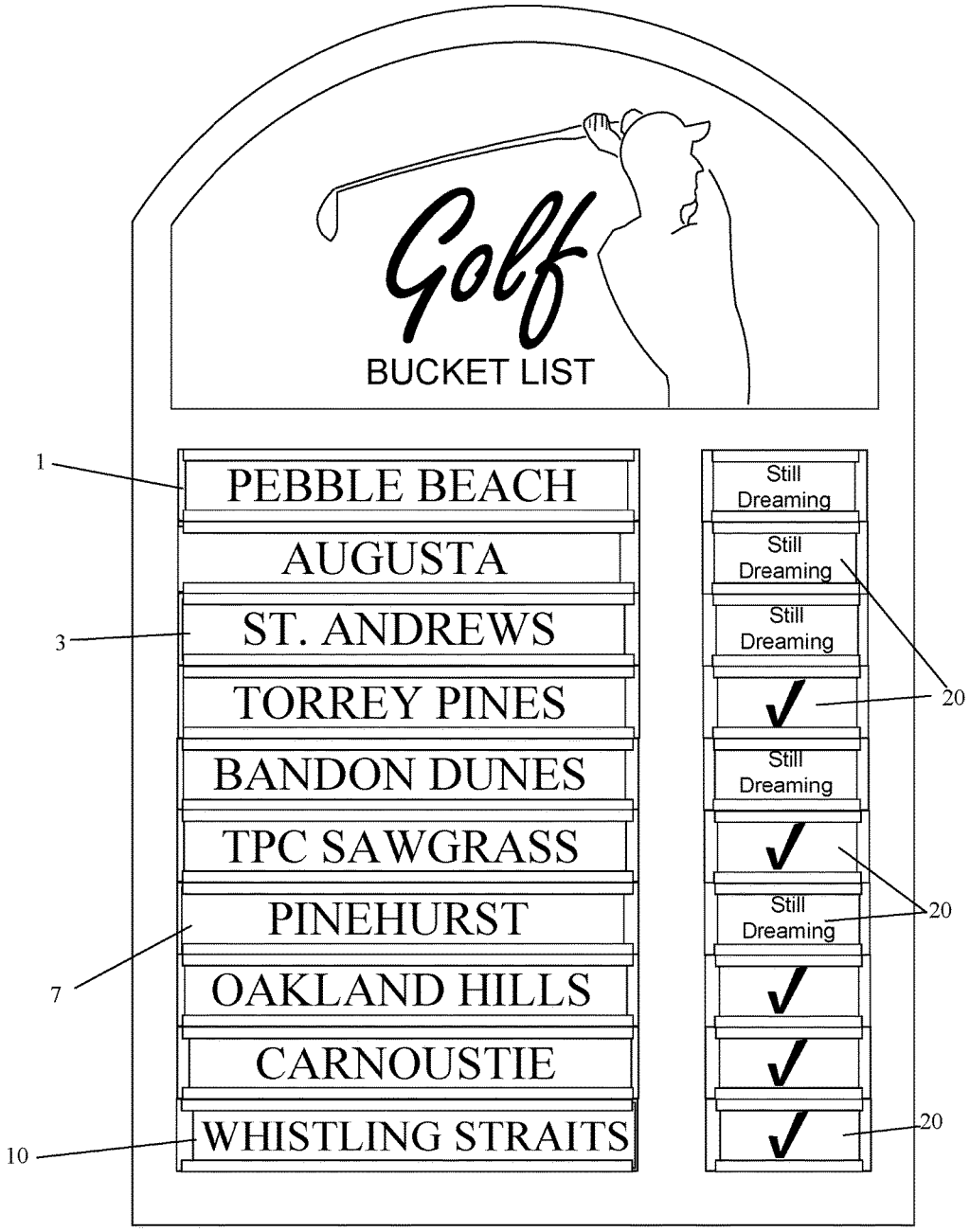
FIG. 5 shows a front view of the preferred embodiment shown in FIG. 1.

In FIG. 5, the user has completed attaching placards 1-10 and all achievement placards 20. FIG. 5 shows the front view of the image also shown earlier in FIG. 1. In FIG. 5 the user has completed the goals that are marked with a checkmark. The user still needs to complete the goals that are indicated by the words "Still Dreaming".

Other Preferred Embodiments

Figure 6:
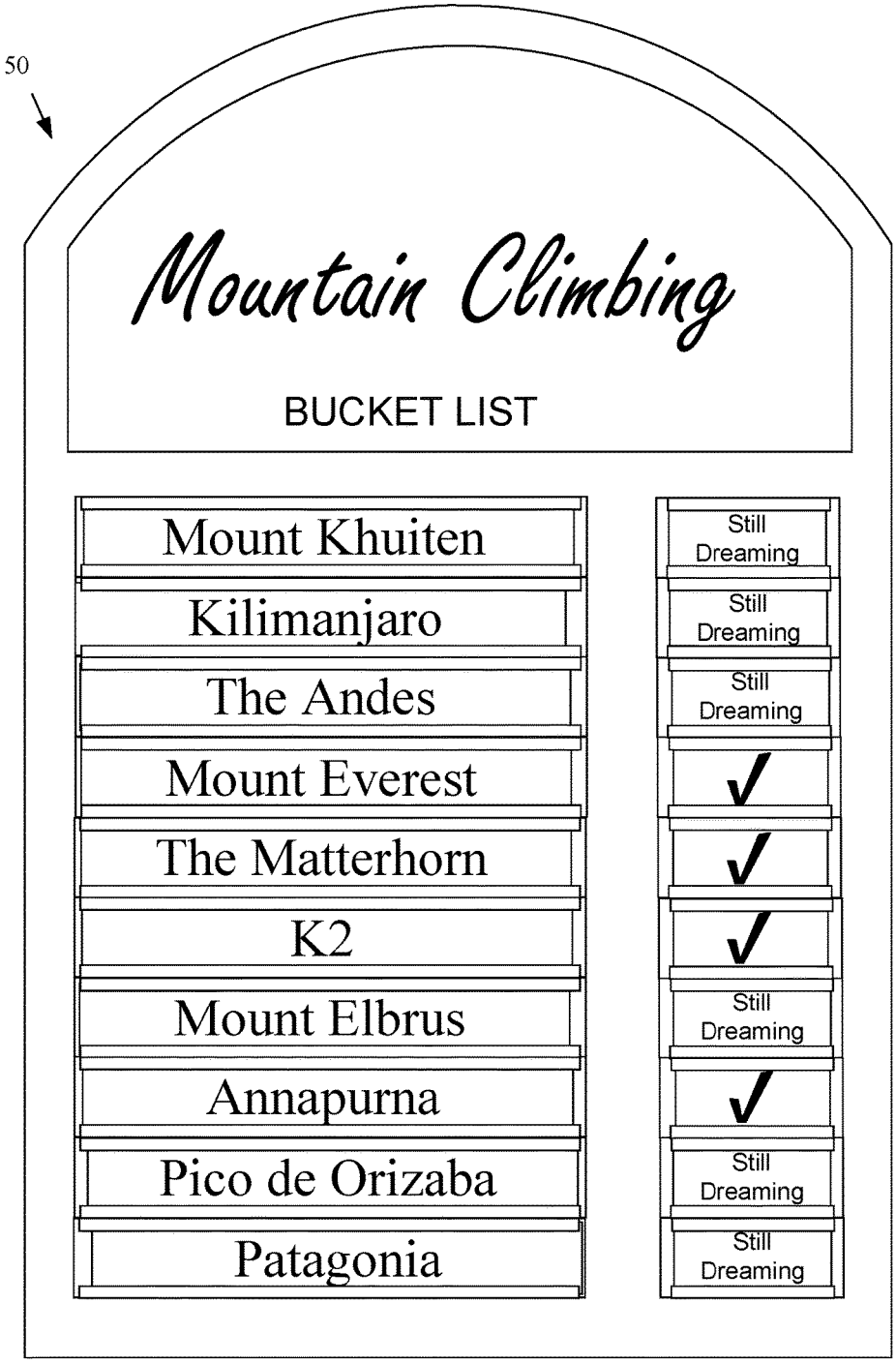
FIG. 6 shows another preferred embodiment of the present invention.

It should be noted that the above discussion of bucket list display device 50 focuses on the utilization of a bucket list that covers prestigious golf courses the user wishes to play on during his lifetime. However, it should be recognized that bucket list display device 50 can be utilized to organize a bucket list of a limitless variety of subjects. For example FIG. 6 shows bucket list display device 50 being utilized to identify mountain peaks that the user wishes to attempt during his lifetime. In FIG. 6, the user has already successfully climbed Mount Everest, the Matterhorn, K2, and Annapurna. However, the user has yet to climb Mount Khuiten, Kilimanjaro, the Andes, Mount Elbrus, Pico de Orizaba, or Patagonia.

Figure 7:
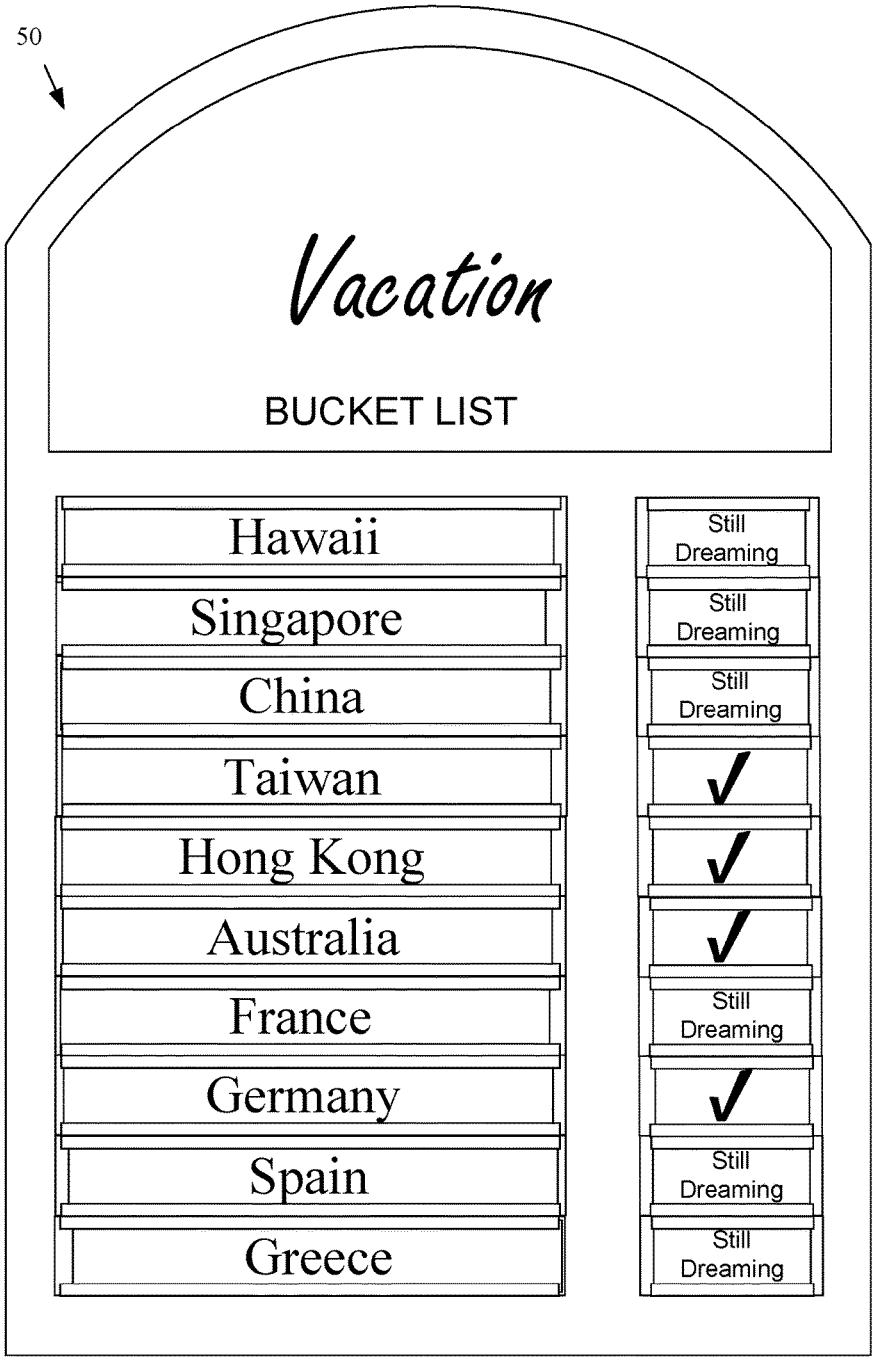
FIG. 7 shows another preferred embodiment of the present invention.

Also, for example, FIG. 7 shows bucket list display device 50 being utilized to identify vacation locations the user wishes to go to during his lifetime. In FIG. 7, the user has already vacationed in Taiwan, Hong Kong, Australia and Germany. However, the user has yet to vacation in Hawaii, Singapore, China, France, Spain or Greece.

Although the above-preferred embodiments have been described with specificity, persons skilled in this art will recognize that many changes to the specific embodiments disclosed above could be made without departing from the spirit of the invention. For example, it was stated above that achievement placards 20 state "Still Dreaming" on one side and a checkmark on the other side. "Still Dreaming" is just one example of a statement that indicates that the goal has not yet been accomplished. Likewise, the checkmark is just one example of a statement that indicates that the goal has been accomplished. It should be understood that "Still Dreaming" and the checkmark can be replaced with a variety of other statements that indicate the same or similar meaning. For example, "Still Dreaming" can be replaced with "Not Yet . . . " and the checkmark can be replaced with "Did it!!!". Also, although it was stated that achievement placards 20 have "Still Dreaming" written on one side and a checkmark written on the other side, it would be possible to have separate achievement placards, with one group of achievement placards displaying "Still Dreaming" and the other group of achievement placards displaying the checkmark. Therefore, the attached claims and their legal equivalents should determine the scope of the invention.

What is claimed is:

1. A method for motivating a user to complete goals and for rewarding a user who has completed goals, said method comprising the steps of:

A) acquiring a bucket list display device, said bucket list display device comprising:
   i. a mounting board,
   ii. a plurality of goal mounts rigidly mounted onto said mounting board,
   iii. a plurality of achievement mounts rigidly mounted onto said mounting board, wherein each said achievement mount is mounted adjacent to one of said plurality of goal mounts,
   iv. a plurality of goal placards removably attached to said plurality of goal mounts, wherein each goal placard lists a desired goal to be achieved, wherein said plurality of goal placards functions to motivate a user of said bucket list display device to accomplish goals listed on said plurality of goal placards, and
   v. a plurality of achievement placards removably attached to said plurality of achievement mounts, wherein each achievement placard lists a statement that indicates if the goal has been accomplished or if it has not been accomplished, wherein said plurality of achievement placards functions to inform a viewer of said bucket list display device that a corresponding goal has been achieved or has not been achieved, B) viewing said plurality of goal placards, C) accomplishing goals listed on said plurality of goal placards, and D) displaying said plurality of achievement placards so that at least one of said plurality of achievement placards lists said statement that indicates the goal has been accomplished.

2. The method as in claim 1, wherein said mounting board comprises a descriptive section describing the purpose of said display device.

3. The method as in claim 1, wherein said plurality of goal mounts and said plurality of achievement mounts are rigidly mounted to said mounting board via screws.

4. The method as in claim 1, wherein said plurality of goal mounts and said plurality of achievement mounts comprise retaining edges to permit said plurality of goal placards and said plurality of achievement placards to slide into said plurality of goal mounts and said plurality of achievement mounts.

5. The method as in claim 1, wherein said goal placards and said achievement placards are slidingly attached to said plurality of goal mounts and said plurality of achievement mounts.

6. The method as in claim 1, wherein said descriptive section describes a golf bucket list and wherein said goal placards refer to golf courses that are desirable for play.

* * * * *